US007290426B2

(12) United States Patent
Landvatter et al.

(10) Patent No.: US 7,290,426 B2
(45) Date of Patent: Nov. 6, 2007

(54) DEVICE FOR LUBRICATING AND COOLING MOLDS, IN PARTICULAR FORGING DIES AND TOOLS IN METAL FORMING

(75) Inventors: Klaus Landvatter, Weinstadt-Endersbach (DE); Hermann Lange, Metzingen (DE)

(73) Assignee: Lechler GmbH, Metzingen (DE)

( * ) Notice: Subject to any disclaimer, the term of this patent is extended or adjusted under 35 U.S.C. 154(b) by 0 days.

(21) Appl. No.: 11/230,328

(22) Filed: Sep. 19, 2005

(65) Prior Publication Data

US 2006/0070421 A1 Apr. 6, 2006

Related U.S. Application Data

(60) Provisional application No. 60/650,419, filed on Feb. 4, 2005.

(30) Foreign Application Priority Data

Sep. 20, 2004 (EP) ..... 04022305

(51) Int. Cl.
*B21D 37/16* (2006.01)

(52) U.S. Cl. ..... 72/342.3; 72/43

(58) Field of Classification Search ..... 72/41, 72/42, 43, 44, 342.1, 342.3; 164/458, 126, 164/128, 154.6; 427/133, 236, 421, 426
See application file for complete search history.

(56) References Cited

U.S. PATENT DOCUMENTS 4,284,670 A * 8/1981 Kole ..... 427/422
5,524,829 A 6/1996 Keim et al.
5,603,984 A * 2/1997 Keim et al. ..... 427/133
5,642,637 A * 7/1997 Crum ..... 72/43
5,916,367 A 6/1999 Wollin
6,546,994 B1 * 4/2003 Renkl et al. ..... 164/154.1
6,705,142 B1 * 3/2004 Rieger et al. ..... 72/42
6,802,459 B2 * 10/2004 Renkl et al. ..... 239/290

FOREIGN PATENT DOCUMENTS

DE 3039914 A1 5/1982

(Continued)

OTHER PUBLICATIONS

European Patent Office Search Report dated Jan. 20, 2005 (3 pages).

(Continued)

*Primary Examiner*—Ed Tolan
(74) *Attorney, Agent, or Firm*—Flynn, Thiel, Boutell & Tanis, P.C.

(57) ABSTRACT

A device which is designed as a spray head and is intended for lubricating and cooling molds, in particular forging dies and tools in metal forming, is described, in which device the feed passages for coolant, compressed air and lubricant are accommodated in a common compact housing but are designed to run separately from one another, and in which spray nozzles are in each case assigned to these separate flow passages, these spray nozzles being specifically designed for spraying the lubricant and the coolant, respectively. By means of this measure, the spraying operation can be designed in an optimum manner and it becomes possible to keep the lubricant and coolant consumption low.

9 Claims, 4 Drawing Sheets

FOREIGN PATENT DOCUMENTS

| | | | |
|---|---|---|---|
| DE | 4420679 | A1 | 3/1995 |
| DE | 19812128 | | 9/1999 |
| EP | 0724486 | | 8/1996 |
| JP | 58167047 | | 10/1983 |
| JP | 6-277782 | * | 10/1994 |

OTHER PUBLICATIONS

"Kuehl- und Schmiersysteme bei Halbwarmanlagen", Umformtechnik, pp. 53-60 (Mar. 1996).

* cited by examiner

Fig. 1
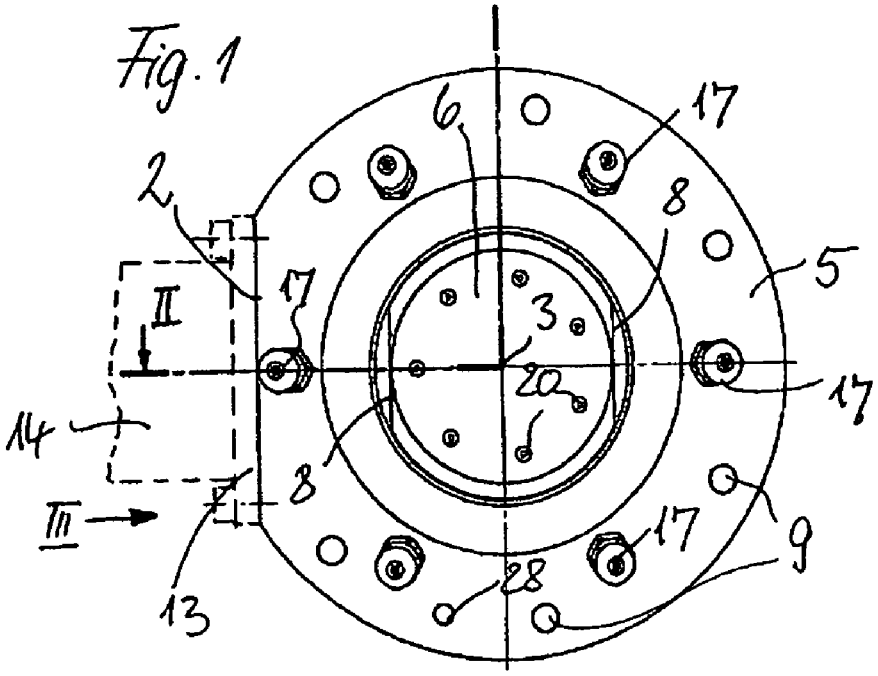
Fig. 2
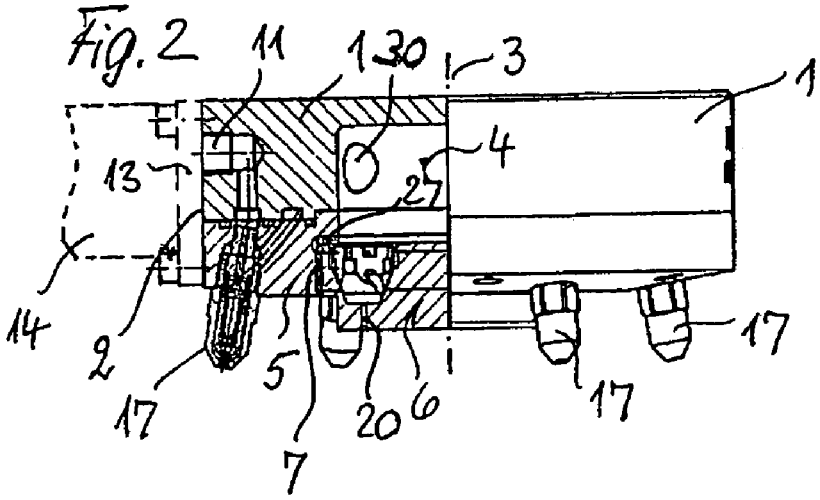
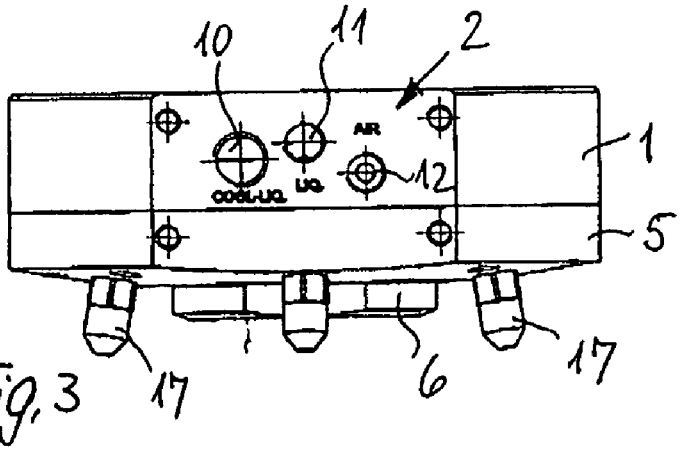
Fig. 3

DEVICE FOR LUBRICATING AND COOLING MOLDS, IN PARTICULAR FORGING DIES AND TOOLS IN METAL FORMING

CROSS-REFERENCE TO RELATED APPLICATIONS

This application claims the benefit of U.S. Provisional Application Ser. No. 60/650 419, filed Feb. 4, 2005, which is incorporated herein in its entirety. The following disclosure is based on European Patent Application No. 04022305, filed Sep. 20, 2004, which is incorporated into this application by reference.

FIELD OF THE INVENTION

The invention relates to a device for lubricating and cooling molds, in particular forging dies and tools in metal forming, having flow passages for feeding a lubricant and a coolant and having nozzles for spraying the lubricant and the coolant.

BACKGROUND OF THE INVENTION

It is known that, for the accurate development of the shape of die-forged parts and for the release of the forged parts from the die and for reducing the tool wear, it is necessary to lubricate the impressions of the dies and to keep the working temperature of the dies within a defined temperature range by cooling. Plate spray heads are known (EP Patent 0724486) which, by making up the external form, can be adapted to the shape of the die and which have, in a plate facing the impression, bores for the discharge of a mixture consisting of lubricant and water. Such spray heads are relatively complicated and have the disadvantage that the lubricant/water mixture cannot be sprayed in an optimum manner, so that the lubricant consumption is relatively high.

Pneumatic atomizer nozzles which are guided by an industrial robot and travel along paths to cover the impression of the die and spray with a lubricant/water mixture are known.

Spray elements, in particular for molds, which produce and deliver a lubricant/coolant mixture have been disclosed, for example, by DE 44 20 679 A1. Considerable effort is required in order to manipulate such individual spray nozzles.

The object of the invention is therefore to simplify such lubricant and cooling devices and in particular to keep the lubricant consumption as low as possible.

SUMMARY OF THE INVENTION

To achieve this object, provision is made in a device of the type mentioned at the beginning for the flow passages for lubricant and the flow passages for coolant to be separate from one another, and for nozzles designed for spraying the lubricant to be assigned to the lubricant flow passages, and for nozzles designed for spraying the coolant to be assigned to the coolant flow passages. By means of this measure, the spray nozzles for coolant on the one hand and for the lubricant on the other hand can be designed in an optimum manner, and, for example, "minimum lubrication nozzles" can be provided for spraying the lubricant, so that the consumption of lubricant can be considerably reduced. The same also applies to the coolant consumption, for optimum nozzle types can be used for spraying the coolant here too.

In an especially advantageous manner, the flow passages for the lubricant and for the coolant may in this case be laid in a common housing, that is to say in a single spray head, it being possible for this housing to be attached in a manner known per se to guide arms which can be moved into the open molds or dies. Separate guidance of coolant or lubricant nozzles therefore becomes unnecessary, and a compact form of a spray head of relatively simple construction can then be achieved in particular when the housing is provided with a central chamber and with at least one cover which covers the chamber, and has flow passages, in particular annular passages, which are subjected separately from the chamber to the admission of at least one of the media required for the spraying operation.

In a development of the invention, the flow passages in the cover may be annular passages which are fed via external feed passages with one of the media required for the spraying operation. These feed passages may in this case open radially into the annular passages. In this case, the central chamber is expediently provided with a feed passage, opening out radially, for the coolant and is closed off by a circular cover disk which is provided with a plurality of coolant nozzles arranged so as to be distributed uniformly over a diameter of the cover disk. This cover disk may in this case be screwed into a cover ring and be closed off toward the central chamber by a flat gasket. This results in a simple construction of the spray device.

In a further configuration of the invention, a swirl insert is arranged upstream of each coolant nozzle, it being possible for these swirl inserts to be screwed into tapped holes which are provided on the side of the coolant nozzle bores which points toward the central chamber.

In a configuration of the invention, the annular passages may be provided as encircling grooves in that region of the housing which surrounds the chamber, these grooves being closed off by a cover ring which encloses the cover disk and into which the cover disk is also screwed.

In a configuration of the invention, the outer annular passage may be connected to a feed passage for lubricant, and the inner annular passage may be connected to a feed passage for compressed air.

In a further configuration, lubricant spray nozzles, in particular in the form of minimum lubrication nozzles, may be provided in the cover ring, these lubricant spray nozzles being arranged so as to be distributed uniformly over a diameter and being connected to respective branch passages for the compressed-air feed, which lead to the inner annular passage. These branch passages in turn may be designed as transverse bores which open into the core hole of the fastening thread for the lubricant spray nozzle.

Finally, the feed passages for coolant, lubricant and compressed air may be laid so as to run parallel to one another in a connection piece which serves as guide arm and via which the device according to the invention, i.e. the spray head according to the invention, can be inserted into the forging die or into the tool.

BRIEF DESCRIPTION OF THE DRAWINGS

The invention is shown with reference to exemplary embodiments in the drawing and is explained below. In the drawing:

FIG. 1 shows the plan view of a device according to the invention, designed as a spray head and having a cylindrical basic form, on the side provided with spray nozzles, FIG. 2 shows the side view of the spray head in FIG. 1 in the direction of section line II, partly cut away, FIG. 3 shows the view of the spray head in FIG. 1 in the direction of arrow III, which shows the connection side, FIG. 6 shows the perspective illustration of one of the swirl inserts to be screwed in.

DETAILED DESCRIPTION OF THE INVENTION

Figure 4:
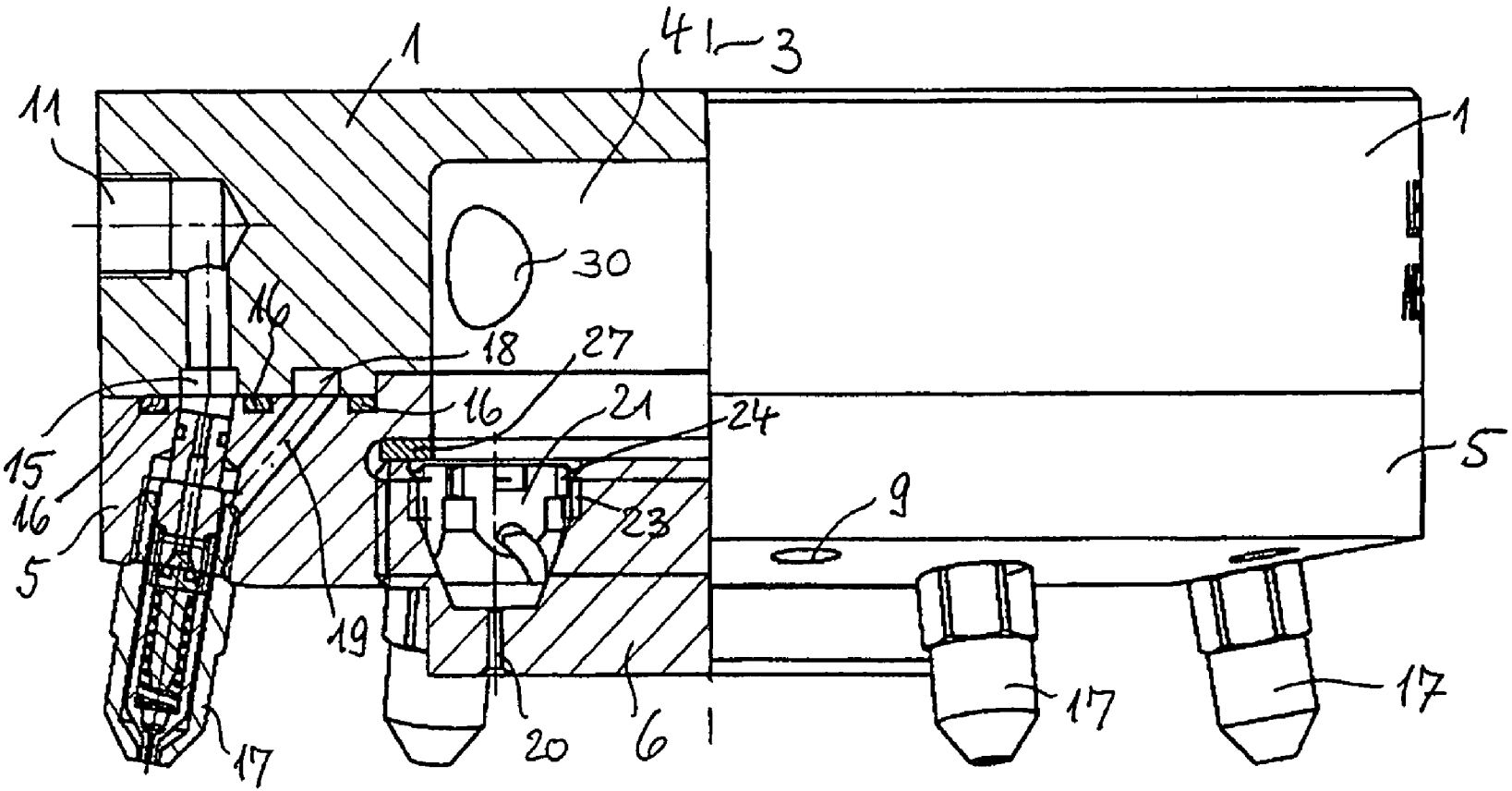
FIG. 4 shows an enlarged illustration of FIG. 2.

FIGS. 1 to 4 show a cylindrical housing 1 in the form of a shell which is open on one side and is provided on one side with a flat 2 which runs parallel to the central axis 3 of the housing 1. In this case, the central chamber 4 of the housing 1 is closed off on the open side by a cover which consists of a cover ring 5 having a lateral flat aligned with the flat 2 and of a cover disk 6 which is screwed into a thread 7 of the cover ring 5 and is provided with lateral parallel application surfaces 8 for a tool for the assembly operation. The countersunk screws 9 hold the cover ring 5 on the housing 1.

As FIG. 3 shows, the flat 2 in the region of the housing 1 is provided with connections for the media to be sprayed; for example, a connection 10 for cooling liquid, a connection 11 for a liquid lubricant and a connection 12 for compressed air are provided. A flange 13 can then be put onto the flat 2, as indicated by broken lines in FIGS. 1 and 2, this flange 13 being part of a connection piece 14 in which the feed lines for the cooling liquid, for the lubricant and for the compressed air run parallel to one another and which may also serve as a guide arm for the spray head according to the invention.

Six spray nozzles 17 for lubricant are provided in the cover ring 5 so as to be uniformly distributed over a diameter, this lubricant being fed via the connection 11 and then leading into an annular passage 15, which is at first designed as an encircling groove on the open side of the housing 1 and is then closed by the mounted cover ring 5 and by inserted sealing rings 16, for example commercially available O-rings. The spray nozzles 17 in this case may be designed as "minimum spray nozzles", which are known per se. Compressed air is fed to these spray nozzles 17 via a further annular passage 18, which is produced as a groove in the same way as the annular passage 15 and is then closed by putting on the cover ring 5 and the sealing rings 16. This inner annular passage 18 is connected via a respective branch bore 19 to the space for the screw-in thread of the respective nozzle 17, so that the spray nozzles 17, apart from being supplied with lubricant, can also be supplied with compressed air for the fine spraying of the lubricant. In this way, the spray nozzles 17 can be specifically designed for the compressed-air atomization of the lubricant. The lubricant consumption can be kept low as a result.

Figure 5:
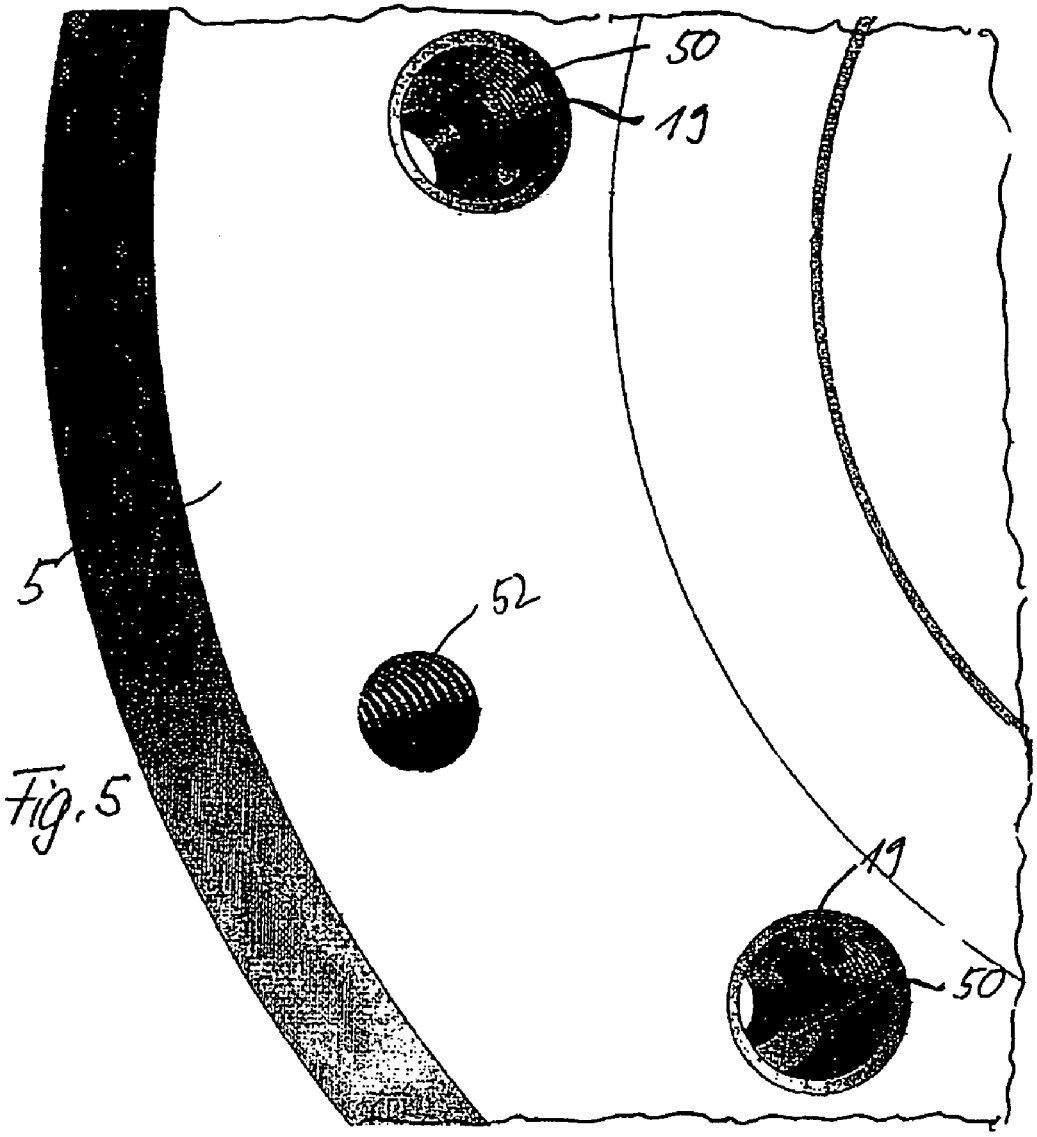
FIG. 5 shows a greatly enlarged partial view of the cover ring of the spray head in FIG. 1 from the inside of the spray head, but without the screwed-in spray nozzles.
Figure 6:
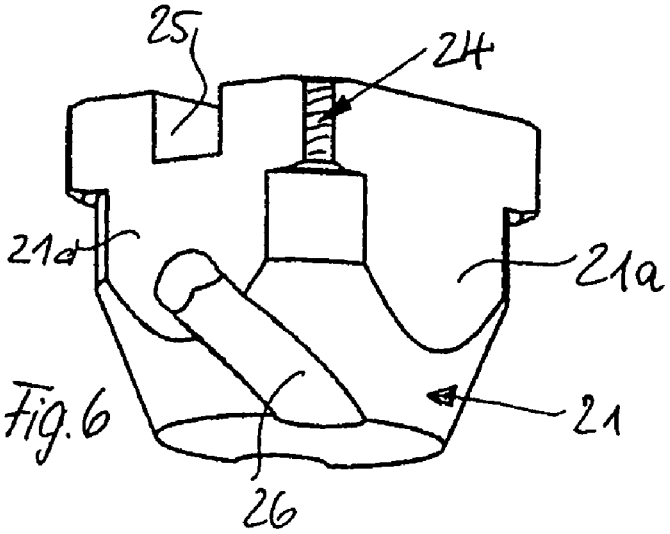

FIG. 5 shows the cover ring 5 in a cutaway and greatly enlarged view. Screw-in threads 50 for the lubricant nozzles 17 and the branch bore 19 opening into the space for the screw-in thread 50 and intended for feeding compressed air can readily be seen. Tapped holes 52 which are provided for the fastening of the cover ring 5 to the housing 1 can also be seen.

In a manner not shown in any more detail, the circular-cylindrical chamber 4 of the housing 1 is connected via an opening 30 provided in its wall to the connection 10 for the cooling liquid, which in this way is directed into the chamber 4 and can be sprayed outward from there via nozzle openings 20. The cooling liquid is introduced tangentially or at least eccentrically through the opening 30, so that stable flow conditions are present in the chamber 4. The cover disk 6 thus forms a cluster nozzle unit having seven nozzle bores 20 in the exemplary embodiment, swirl inserts 21 with which a conical jet is to be produced at the outlet of the nozzle bores 20 being arranged in each case upstream of said nozzle bores 20, as can be seen in particular from FIG. 4. In this case, the swirl inserts 21, as FIG. 4 shows, are screwed into a corresponding thread 23 from that side of the locating holes 22 for the swirl inserts 21 which faces the chamber 4, rounded-off corners 24 of each swirl insert 21, which are provided with threaded parts, engaging in this thread 23. For the application of a tool, the swirl inserts 21 have an application groove 25. Flattened side faces 21*a*, which then merge into swirl passages 26, enable the coolant to pass through. The cover disk 6 has a thread on its circumference and is screwed into a matching thread on the cover ring 5. The cover disk 6 is sealed off from the cover ring 5 via a flat gasket ring 27. The spray head in FIGS. 1 to 4 is designed for spraying coolant and lubricant to one side. It can be adapted in its dimensions to the die to be sprayed or to a tool for metal forming. Its external form and also the arrangement of the spray nozzles 17 and of the spray openings 20 may therefore deviate from the circular shape.

It may also be mentioned that the mutual rotation of housing 1 or housing ring 1*a* is locked by a straight pin 28 which runs parallel to the axis 3, reaches through the cover ring 5 and in each case is directed right into the housing 1 or the housing 1*a*.

Figure 7:
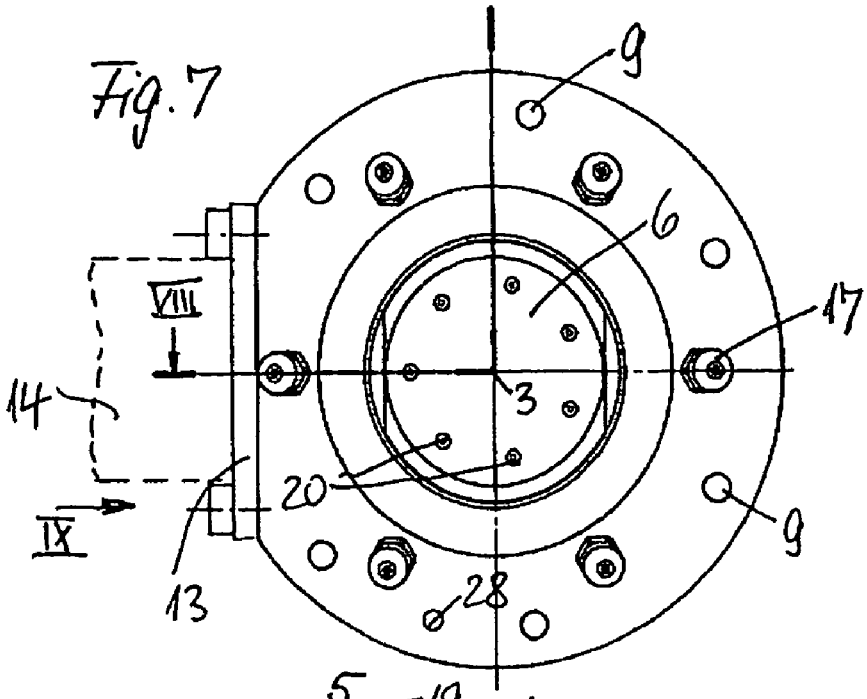
FIG. 7 shows the view of the spray head in FIG. 1, which spray head, however, is suitable for spraying coolant and lubricant to both sides.
Figure 8:
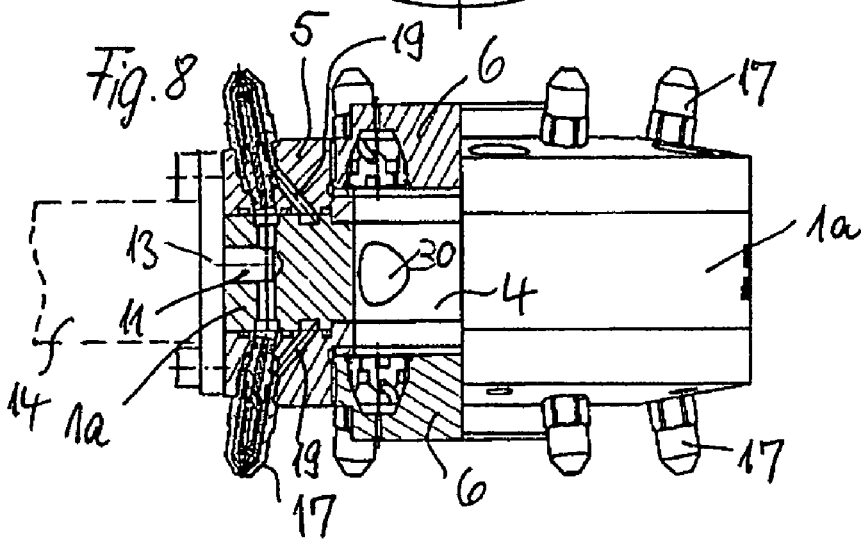
FIG. 8 shows the side view, cut away along section line VIII, of the spray head in FIG. 7.
Figure 9:
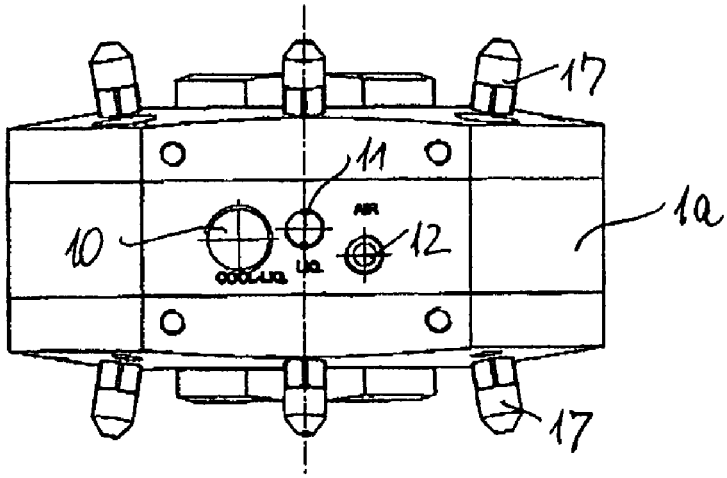
FIG. 9 shows—in a similar manner to FIG. 3—the view of the spray head in FIGS. 7 and 8 in the direction of its connection point.

FIGS. 7 to 9 now show a spray head which corresponds in construction to that in FIGS. 1 to 4 but which is designed for spraying a mold on both sides. The same parts are therefore provided with the same reference numerals. A difference here is that the housing 1' is not designed as a shell closed on one side but as a housing ring which is constructed on both sides from a cover consisting of the cover ring 5 and the cover disk 6 screwed into the latter. To fasten the covers to the housing 1', one of the cover rings has tapped holes, the second cover ring has countersunk holes for countersunk heads, and the housing 1' has through-holes. The two covers are thus connected to one another and to the housing 1' by means of through-bolts.

During operation, cooling liquid is therefore introduced through the connection 10 into the chamber 4 and is distributed there in the form of conical jets outward through the nozzle bores 20. The liquid lubricant flows through the connection 11 into the annular passage 15 and flows outward from there through the spray nozzles 17. The atomizing air coming from the inner annular passage 18 ensures that the lubricant fed via the stepped bore in front of the spray nozzles 17 is split into very fine droplets.

The invention claimed is:

1. A device for lubricating and cooling molds or dies, having flow passages for feeding a lubricant and a coolant and having nozzles for spraying the lubricant and the coolant, wherein the flow passages for lubricant and the flow passages for coolant are laid in a common housing, which can be attached to guide arms which can be moved into the open molds or dies, and are separate from one another, with nozzles designed for spraying the lubricant assigned to the lubricant flow passages, and nozzles designed for spraying the coolant assigned to the coolant flow passages, and wherein the housing is provided with a central chamber, and the central chamber is provided with a feed passage, opening out eccentrically and in particular tangentially, for the coolant and is closed off by a circular cover disk which is provided with a plurality of coolant bores arranged so as to be distributed uniformly over a diameter of the cover disk.

2. The device as, claimed in claim 1, wherein the cover disk is screwed into a cover ring and is closed off toward the central chamber by a flat gasket ring.

3. The device as claimed in claim 2, wherein annular passages are provided as encircling grooves in that region of the housing which surrounds the chamber, these grooves being closed off by the cover ring which encloses the cover disk.

4. The device as claimed in claim 3, wherein the outer annular passage is connected to a feed passage for lubricant, and the inner annular passage is connected to a feed passage for compressed air.

5. The device as claimed in claim 3, wherein lubricant spray nozzles, in particular in the form of minimum lubrication nozzles, are provided on the cover ring, these lubricant spray nozzles being arranged so as to be distributed uniformly over a diameter and being connected to respective branch passages for the compressed-air feed, which lead to the inner annular passage.

6. The device as claimed in claim 5, wherein the branch passages are designed as transverse bores which open into the core hole of the fastening thread for the lubricant spray nozzle.

7. The device as claimed in claim 4, wherein the feed passages for coolant, lubricant and compressed air are laid in a common housing and at least sections thereof are laid so as to run parallel to one another in a connection piece serving as guide arm.

8. The device as claimed in claim 1, wherein a swirl insert is arranged upstream of each coolant bore.

9. The device as claimed in claim 8, wherein each swirl insert is screwed into a tapped hole, these tapped holes being provided on the side of the coolant nozzle bores which points toward the central chamber.

* * * * *